US006094402A

United States Patent [19]

Cooper et al.

[11] Patent Number: 6,094,402

[45] Date of Patent: Jul. 25, 2000

[54] ULTRASONIC TRANSDUCER

[75] Inventors: Stephen R. W. Cooper, Fowlerville; Neil G. Murray, Jr., Wixom, both of Mich.

[73] Assignee: TRW Inc., Lyndhurst, Ohio

[21] Appl. No.: 09/197,909

[22] Filed: Nov. 23, 1998

[51] Int. Cl.[7] ..... H04R 1/02

[52] U.S. Cl. ..... 367/188; 367/173; 367/174

[58] Field of Search ..... 367/140, 173, 367/174, 178, 188

[56] References Cited

U.S. PATENT DOCUMENTS

| | | | |
|---|---|---|---|
| 4,685,091 | 8/1987 | Chung et al. | 367/31 |
| 4,739,860 | 4/1988 | Kobayashi et al. . | |
| 4,754,440 | 6/1988 | Naruse . | |
| 4,980,873 | 12/1990 | Gross et al. . | |
| 5,301,170 | 4/1994 | James . | |
| 5,612,930 | 3/1997 | Hazony et al. | 367/140 |

*Primary Examiner*—Ian J. Lobo
*Attorney, Agent, or Firm*—Tarolli, Sundheim, Covell, Tummino & Szabo L.L.P.

[57] ABSTRACT

An ultrasonic transducer (10) includes a housing (12) having a main section (14) and a base section (16). Retainer elements (20) on the main and base sections (14 and 16) of the housing (12) are engageable only when the main and base sections of the housing are in a predetermined orientation relative to each other. The retainer elements (20) press the main and base sections (14 and 16) of the housing (12) together and securely interconnect the main and base sections of the housing. A diaphragm (82) is formed in an end portion of the main section (14) of the housing (12) opposite from the retainer elements (20). A ridge (88) projects axially outward from the diaphragm (82) to protect the diaphragm and decouple the diaphragm from a side wall (74) of the housing (12). Acoustically absorptive material (114 and 116) is disposed in the housing.

7 Claims, 5 Drawing Sheets

ULTRASONIC TRANSDUCER

BACKGROUND OF THE INVENTION

The present invention relates to a new and improved ultrasonic transducer and more specifically to a housing for an ultrasonic transducer.

Known ultrasonic transducers have been used to produce ultrasonic waves in response to electrical energization of the transducers. In addition, known ultrasonic transducers have been utilized to produce an electrical signal in response to sonic waves. At least some known ultrasonic transducer housings have diaphragms which should be protected so that when the ultrasonic transducer is dropped, the performance characteristics of the ultrasonic transducer are not changed. Known ultrasonic transducers are disclosed in U.S. Pat. Nos. 4,739,860; 4,754,440; 4,980,873; and 5,301,170.

SUMMARY OF THE INVENTION

The present invention relates to a new and improved ultrasonic transducer having retainer elements which interconnect sections of a housing. The retainer elements are spaced apart about the periphery of the housing so that the sections of the housing can be interconnected only when they are in a predetermined orientation relative to each other. The retainer elements press the sections of the housing against each other to tightly close a joint between the sections of the housing.

A diaphragm formed in one of the sections of the housing is protected by a ridge. The ridge extends outward from the diaphragm and has a greater structural rigidity than the diaphragm. Acoustically absorptive material is disposed in the housing.

BRIEF DESCRIPTION OF THE DRAWINGS

The foregoing and other features of the present invention will become apparent to one skilled in the art to which the present invention relates upon consideration of the following description of the invention with reference to the accompanying drawings wherein.

DESCRIPTION OF SPECIFIC PREFERRED EMBODIMENTS OF THE INVENTION

Housing—Retainer Elements

Figure 1:
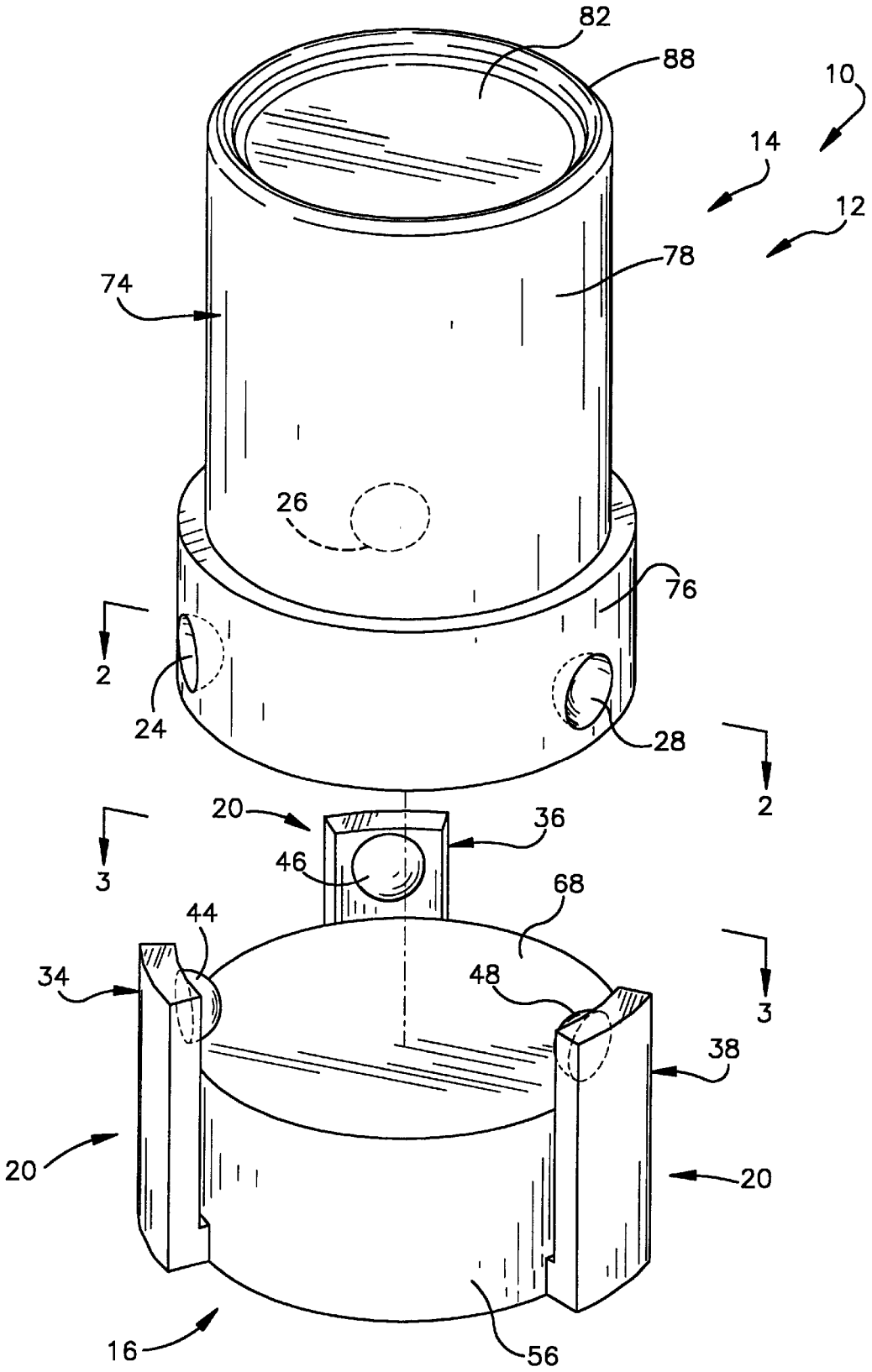
FIG. 1 is an exploded pictorial illustration of an ultrasonic transducer housing constructed in accordance with the present invention.

An ultrasonic transducer 10 (FIG. 1) has a housing 12 constructed in accordance with the present invention. The housing 12 includes a main section 14 and a base section 16. Retainer elements 20 are provided to interconnect the main and base section 16 only when they are in a predetermined orientation relative to each other.

The retainer elements 20 include a plurality of recesses 24, 26 and 28 (FIGS. 1 and 2) formed in the main section 14 of the housing 12. In addition, the retainer elements 20 include a plurality of retainer arms 34, 36 and 38 (FIGS. 1 and 3) disposed on the base section 16 of the housing. Projections 44, 46 and 48 on the retainer arms 34, 36 and 38 are engageable with the recesses 24, 26 and 28 (FIG. 2) formed in the main section 14 of the housing 12.

In accordance with one of the features of the present invention, the projections 44, 46 and 48 (FIG. 1) on the retainer arms 34, 36 and 38 are engageable with the recesses 24, 26 and 28 only when the main section 14 and base section 16 of the housing 12 are in a predetermined orientation relative to each other. To enable the main section 14 and base section 16 of the housing to be interconnected only when they are in one specific orientation relative to each other, the spacing is not the same between the recesses 24, 26 and 28 (FIG. 2). In addition, the spacing is not the same between the projections 44, 46 and 48 (FIG. 3). The retainer elements 20 are spaced different arcuate distances apart in opposite directions about the housing 12.

The recesses 24 and 26 are spaced apart by a first arcuate distance, indicated at 52 in FIG. 2. The recesses 26 and 28 are spaced apart by a second arcuate distance, indicated at 54 in FIG. 2. The arcuate distance 54 is different than the arcuate distance 52. Similarly, the recesses 24 and 28 are spaced apart by an arcuate distance 56. The arcuate distance 56 is different than the arcuate distance 52.

In the specific embodiment of the retainer elements 20 illustrated in FIG. 2, the arcuate distances 54 and 56 are equal to each other and are larger than the arcuate distance 52. However, it is contemplated that the arcuate distances 54 and 56 could be unequal and could be either larger or smaller than the arcuate distance 52.

The retainer elements 20 are spaced different arcuate distances apart in different directions about the periphery of the housing 12. Thus, the recess 24 (FIG. 2) is spaced from the recess 26 by the arcuate distance 52 in a clockwise direction about the main section 14 of the housing 12. The recess 24 is spaced from the recess 26 by a greater arcuate distance in a counterclockwise direction about the main section 14 of the housing 12. Thus, in a counterclockwise direction about the main section 14 of the housing 12, the recess 24 is spaced from the recess 26 by the sum of the arcuate distance 56 and the arcuate distance 54.

The retainer arms 34, 36, and 38 (FIG. 3) have the same arcuate spacing as the recesses 24, 26 and 28 with which they cooperate. Thus, the projections 44 and 46 on the retainer arms 34 and 36 are spaced apart by the arcuate distance 52. Similarly, the projections 46 and 48 on the retainer arms 36 and 38 are spaced apart by the arcuate distance 54. The projections 44 and 48 on the retainer arms 34 and 38 are spaced apart by the arcuate distance 56.

In the illustrated embodiment of the retainer elements 20, the arcuate distance 52 which the projections 44 and 46 are spaced apart is different than the arcuate distance 54 which the projections 46 and 48 are spaced apart. The arcuate distance 56 which the projections 44 and 48 are spaced apart is different than the arcuate distance 52 which the projections 44 and 46 are spaced apart. As was previously mentioned, the arcuate distance 54 is equal to the arcuate distance 56. However, the arcuate distances 54 and 56 do not have to be equal.

As was previously mentioned, the retainer elements 20 are spaced different arcuate distances apart in different directions about the periphery of the housing 12. Thus, the projection 44 (FIG. 3) is spaced from the projection 46 by the arcuate distance 52 in a clockwise direction about the base section 16 of the housing 12. The projection 44 is spaced from the projection 46 by a greater distance in a counterclockwise direction about the base section 16 of the housing 12. Thus, in a counterclockwise direction about the base section 16 of the housing 12, the projection 44 is spaced from the projection 46 by the sum the arcuate distance 56 and the arcuate distance 54.

Figure 2:
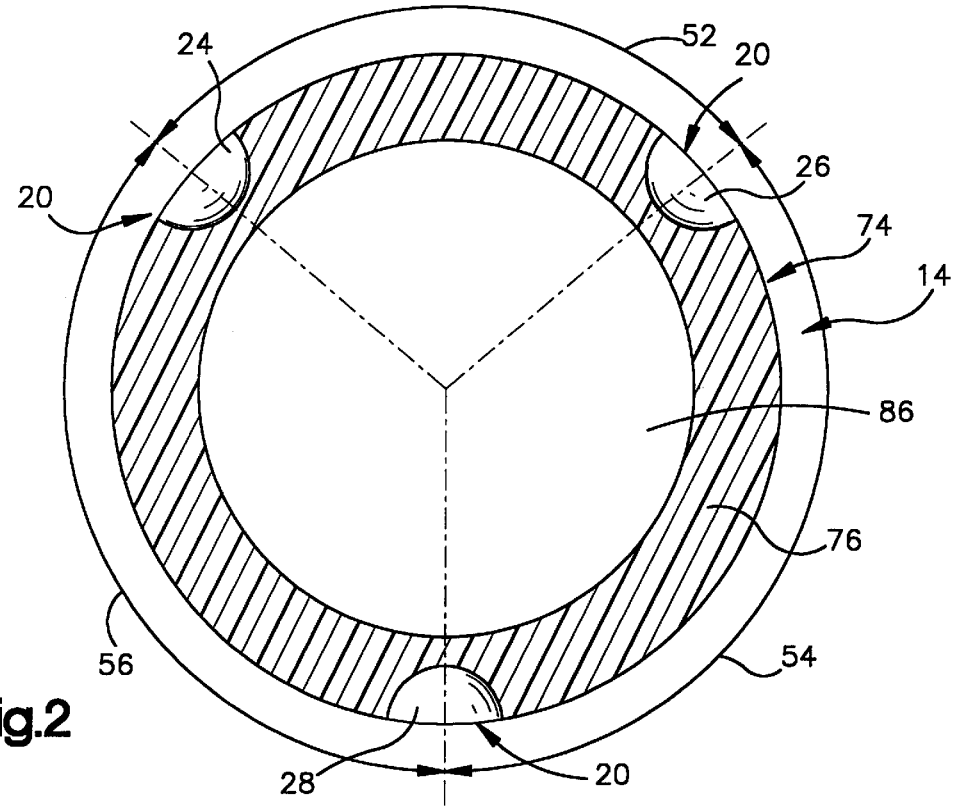
FIG. 2 is a sectional view, taken generally along the line 2—2 of FIG. 1, illustrating spacing between retainer elements on a main section of the housing.
Figure 3:
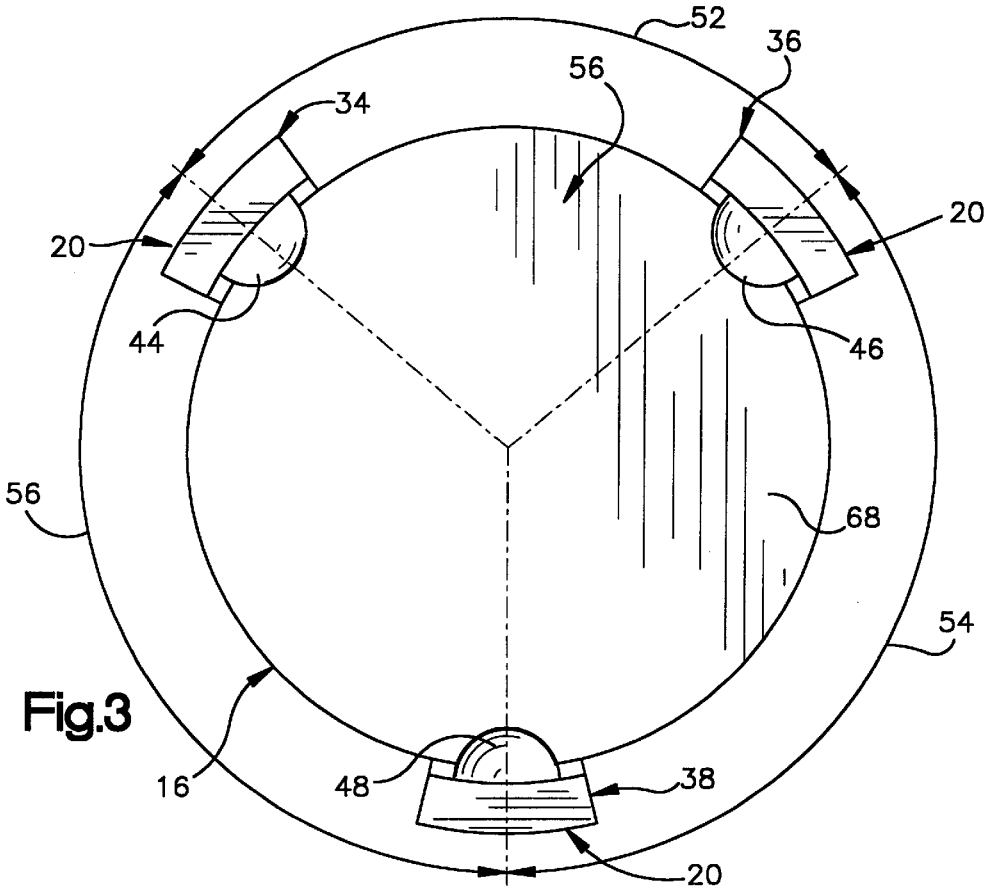
FIG. 3 is a plan view, taken generally along the line 3—3 of FIG. 1, illustrating the spacing between retainer elements disposed on a base section of the housing.

In the specific embodiment of the invention illustrated in FIGS. 1–3, the arcuate distance 52 which the recesses 24 and 26 (FIG. 2) are spaced apart and which the projections 44 and 46 (FIG. 3) are spaced apart is 100 degrees. The arcuate distance 54 which the recesses 26 and 28 are spaced apart and which the projections 46 and 48 are spaced apart is 130 degrees. The arcuate distance 56 which the recesses 24 and 28 are spaced apart and which the projections 44 and 48 are spaced apart is 130 degrees. By having the recesses 24, 26 and 28 spaced unequal distances apart about the periphery of the main section 14 and having the projections 44, 46 and 48 spaced unequal distances apart about the periphery of the base section 16, the retainer elements 20 can only be engaged when the main and base sections 14 and 16 of the housing are in a predetermined orientation relative to each other.

As was previously mentioned, the retainer elements 20 are spaced different arcuate distances apart in different directions about the periphery of the housing 12. Thus, in the specific embodiment of the invention illustrated in FIGS. 2 and 3, the recess 24 and projection 44 are spaced 100 degrees from the recess 26 and projection 46 in a clockwise direction about the housing 12. The recess 24 and projection 44 are spaced 260 degrees from the recess 26 and projection 46 in a counterclockwise direction about the housing 12.

In the illustrated embodiment of the invention, there are three retainer elements on the main section 14 and on the base section 16 of the housing. However, it is contemplated that either a greater or lesser number of retainer elements 20 could be provided on the main section 14 and base section 16 of the housing. For example, if two retainer elements 20 were utilized, they would be spaced apart by an arcuate distance which would be greater than 180 degrees in one direction about the periphery of the main section 14 and base section 16 of the housing 12. The two retainer elements 20 would be spaced apart by a distance which is less than 180 degrees in the opposite direction about the periphery of the main section 14 and base section 16 of the housing.

In accordance with one of the features of the present invention, the retainer elements 20 are effective to press the main section 14 (FIG. 1) of the housing 12 against the base section 16 of the housing. By pressing the main section 14 against the base section 16 of the housing 12, a tight joint is provided between the sections of the housing. In addition, the force provided by the retainer elements 20 urging the main section 14 of the housing against the base section 16 of the housing 12 compensates for material creep. This may be particularly advantageous if a friction or interference fit is implemented by forcing an over sized transducer housing 12 into a smaller flexible or deformable fixture.

To press the main section 14 of the housing 12 against the base section 16, the projections 44, 46 and 48 on the retainer arms 34, 36 and 38 (FIGS. 1 and 3) apply force against the recesses 24, 26 and 28 (FIG. 2) in the main section of the housing. The force applied against the recesses 24, 26 and 28 by the projections 44, 46 and 48 urges the main section 14 downward (as viewed in FIG. 4) against the base section 16. Tension forces transmitted through the retainer arms 34, 36 and 38 (FIGS. 1 and 3) are applied to the surfaces of the recesses 24, 26 and 28 (FIG. 2) by the projections 44, 46 and 48. These tension forces press an annular end surface 54 (FIG. 4) of the main section 14 against a cylindrical body 56 of the base section 16.

When the main section 14 of the housing 12 is to be connected with the base section 16 of the housing, the main section 14 is moved axially downward (as viewed in FIG. 4) toward the cylindrical body 56 of the base section 16. As this occurs, the annular end surface 54 on the main section 14 of the housing 12 applies force against the projections 44, 46 and 48. The retainer arms 34, 36 and 38 are resiliently deflected radially outward from the central axis of the cylindrical body 56 of the base section 16 by the main section of the housing.

Figure 4:
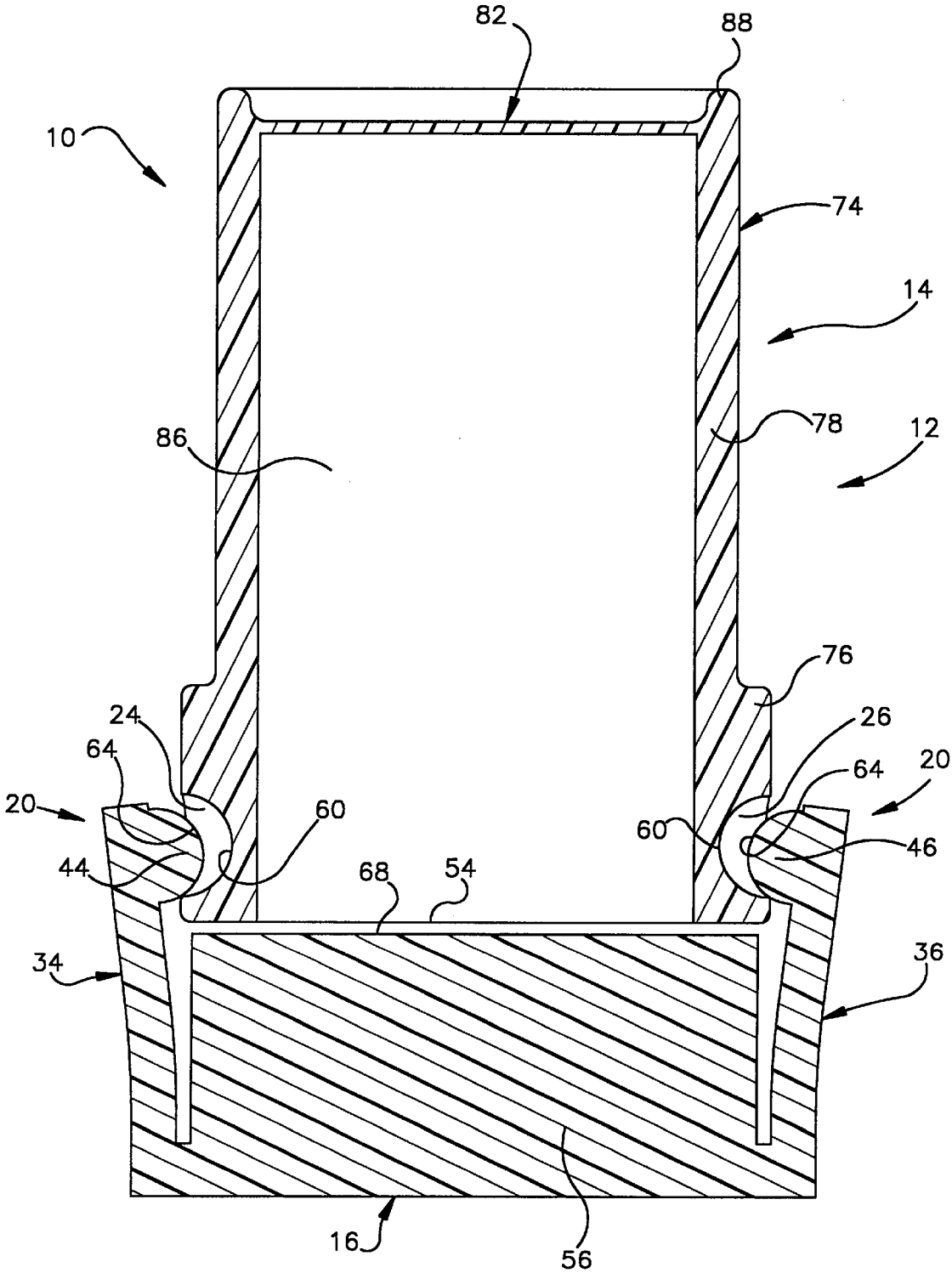
FIG. 4 is a sectional view of the transducer housing and illustrating the manner in which the retainer elements are engaged during interconnection of the main and base sections of the housing.

Further downward (as viewed in FIG. 4) movement of the main section 14 of the housing 12 toward the base section 16 results in the projections 44, 46 and 48 (FIG. 3) moving into the recesses 24, 26 and 28 (FIG. 2) in the main section 14 of the housing 12 (FIG. 4). As this occurs, the projections 44, 46 and 48 are pressed into the recesses 24, 26, and 28 by the resiliently deflected retainer arms 34, 36 and 38. The projections 44, 46 and 48 can enter the recesses 24, 26 and 28 only when the main section 14 and base section 16 are angularly aligned with each other.

When the projections 44, 46 and 48 have entered the recesses 24, 26 and 28, the retainer arms 34, 36 and 38 press the lower (as viewed in FIGS. 4 and 5) portions of the projections 44, 46 and 48 against hemispherical side surfaces 60 of the recesses 24, 26 and 28. At this time, the centers of curvature of hemispherical outer side surfaces 64 on the projections 44, 46 and 48 are offset downward (as viewed in FIGS. 4 and 5) from the centers of curvature from the hemispherical side surfaces 60 of the recesses 24, 26 and 28. This results in the retainer arms 34, 36 and 38 being tensioned by forces transmitted between the side surfaces 60 and 64 of the projections 44, 46 and 48 and recesses 24, 26 and 28.

Figure 5:
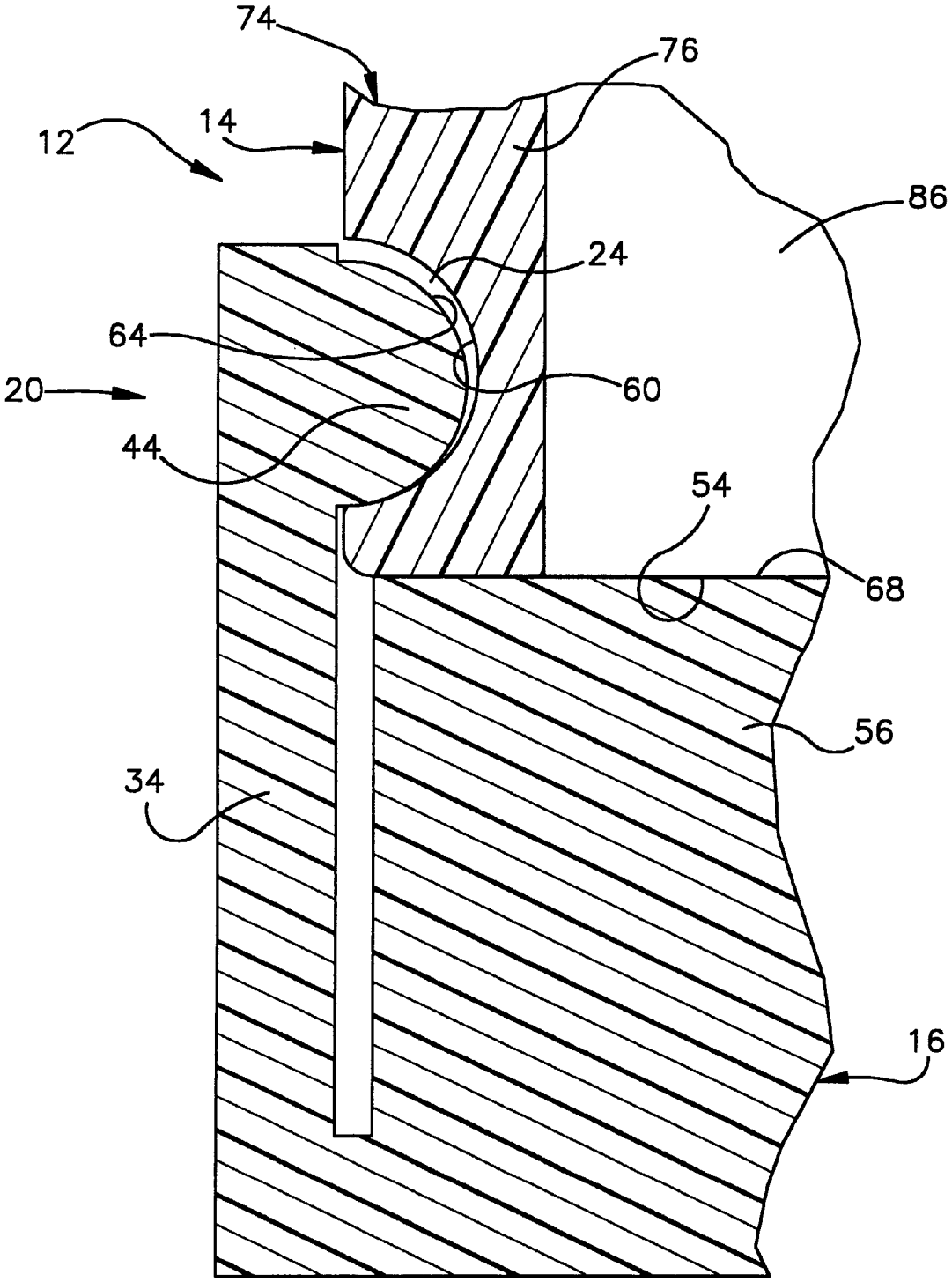
FIG. 5 is an enlarged fragmentary sectional view, illustrating the manner in which a retainer element presses the main and base sections of the housing together.

The tension forces in the retainer arms 34, 36 and 38 firmly press the annular end surface 54 on the main section 14 of the housing 12 against a flat circular upper side surface 68 on the cylindrical body 56 of the base section 16 (FIG. 5). The tension in the retainer arms 34, 36 and 38 is effective to press the main section 14 of the housing 12 against the base section 16 with sufficient force to compensate for any creep which may occur in the materials of the housing 12.

In the illustrated embodiment of the invention, the projections 44, 46 and 48 have hemispherical outer side surfaces 64 which engage hemispherical inner side surfaces 60 of the recesses 24, 26 and 28. However, the projections 44, 46 and 48 and recesses 24, 26 and 28 could have a different configuration if desired. The projections 44, 46 and 48 and recesses 24, 26 and 28 could have complimentary cylindrical, rectilinear or inclined configurations if desired. For example, the projections 44, 46 and 48 and recesses 24, 26 and 28 could have wedge-shaped configurations.

Housing—Walls

The main section 14 of the transducer housing 12 includes a cylindrical side wall 74 (FIGS. 2 and 4). The side wall 74 has a cylindrical reinforcing section 76 (FIG. 4) and a cylindrical body section 78. When the main section 14 of the housing 12 is connected with the base section 16, the cylindrical reinforcing section 76 and the cylindrical body section 78 of the side wall 74 are disposed in a coaxial relationship with the cylindrical body 56 of the base section 16 (FIG. 4).

The reinforcing section 76 has a greater radial thickness than the body section 78 of the side wall 74. This enables the hemispherical recesses 24, 26 and 28 to be formed in the reinforcing section 76 without significantly weakening the main section 14 of the housing 12. The thick reinforcing section 76 avoids stressing and/or deformation of the housing 12 by the projections 44, 46 and 48 on the retainer arms 34, 36, and 38. Therefore, the acoustic properties of the housing 12 are not altered by force transmitted between the housing and the retainer arms 34, 36 and 38. In addition, the relatively thick reinforcing section 76 enables the retainer arms 34, 36 and 38 to pull the main section 14 against the base section 16 of the housing 12 without deflecting the thinner cylindrical body section 78 of the side wall 74.

Although the illustrated housing 12 has a generally cylindrical configuration, the housing could have a different configuration. For example, the housing 12 could have a polygonal configuration. Alternatively, the side wall 74 could have an elliptical configuration.

A flexible diaphragm 82 is formed at a closed end of the main section 14 of the housing 12 opposite from the reinforcing section 76. During use of the ultrasonic transducer 10, the diaphragm 82 may be vibrated in response to an electrical signal to a transducer element (not shown in FIG. 4) in a cylindrical chamber 86 in the main section 14 of the housing. Alternatively, the diaphragm 82 may be vibrated by impact of a sonic wave against the diaphragm 82 to activate the transducer element in the cylindrical chamber 86.

The diaphragm 82 has a circular configuration. The diaphragm 82 is relatively thin so that it can readily vibrate or oscillate under the influence of a transducer element within the chamber 86 or of a sonic wave outside of the housing 12. The circular diaphragm 82 is disposed in a coaxial relationship with the cylindrical side wall 74 of the main section 14 of the housing. The diaphragm 82 extends parallel to and is coaxial with the circular upper side surface 68 on the body 56 of the base section 16 (FIG. 4). In the illustrated embodiment of the invention, the diaphragm 82 has a circular configuration. However, the diaphragm 82 could have a different configuration if desired.

In accordance with one of the features of the present invention, an annular ridge 88 extends around the diaphragm 82. The ridge 88 projects axially outward from the diaphragm 82. This enables the ridge 88 to protect the diaphragm 82 if the ultrasonic transducer 10 should be accidentally dropped with the diaphragm downward. The annular ridge 88 also protects the diaphragm against impacts with objects in the environment around the ultrasonic transducer 10 during installation and/or use of the ultrasonic transducer.

In addition to protecting the diaphragm 82, the ridge 88 decouples the diaphragm from the cylindrical side wall 74 of the main section 14 of the housing 12. This minimizes flexion of the diaphragm 82 by the application of loads to the main section 14 or base section 16 of the housing 12. In addition, the ridge 88 prevents flexion of the diaphragm 82 under the influence of forces transmitted from the retainer arms 34, 36 and 38 to the main section 14 of the housing during pressing of the main section against the base section 16 of the housing. By utilizing the ridge 88 to decouple the diaphragm 82 from the remainder of the housing 12, the diaphragm will have the desired oscillation characteristics and form a focused beam.

The chamber 86 in the housing 12 has a relatively long axial extent. This enables the chamber 86 to hold both a transducer element and acoustically absorptive material, such as foam rubber. The acoustically absorptive material in the chamber 86 serves to acoustically isolate the transducer element from the environment around the ultrasonic transducer 10. This enables the ultrasonic transducer 10 to function in the desired manner even though there are disruptive influences in the environment around the ultrasonic transducer.

Ultrasonic Transducer—First Embodiment

Figure 6:
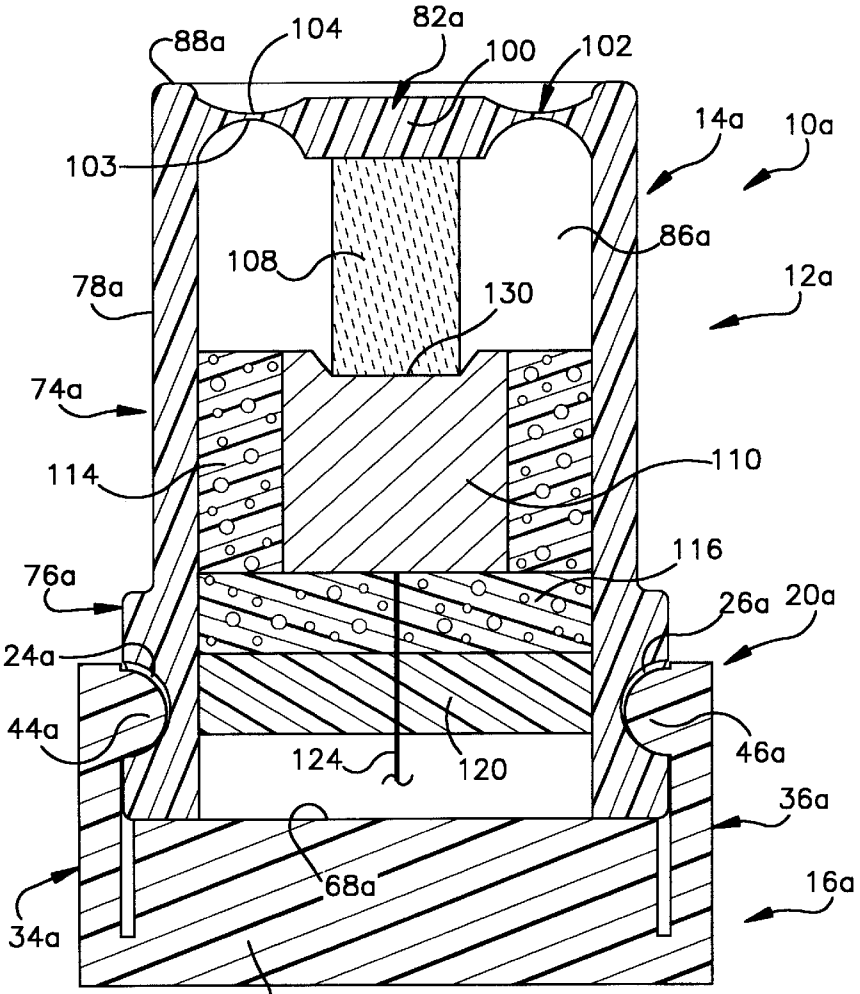
FIG. 6 is a sectional view of an embodiment of an ultrasonic transducer having a housing constructed in accordance with the present invention.

The improved housing 12 for an ultrasonic transducer 10 has been illustrated in FIGS. 1 through 5. It is contemplated that the housing 12 of FIGS. 1 through 5 could be utilized with many different known types of ultrasonic transducers. One specific known ultrasonic transducer with which the housing 12 could be used is illustrated in FIG. 6. Since the embodiment of the invention illustrated in FIG. 6 is generally similar to the embodiment of the invention illustrated in FIGS. 1–5, similar numerals will be utilized to designate similar components, the suffix letter "a" being associated with the numerals of FIG. 6 to avoid confusion.

An ultrasonic transducer 10*a* has an improved housing 12*a*. The housing 12*a* includes a main section 14*a* and a base section 16*a*. The main section 14*a* of the housing 12*a* includes a cylindrical side wall 74*a*. The side wall 74*a* has a cylindrical reinforcing section 76*a* which is disposed in a coaxial relationship with a cylindrical body section 78*a*.

Retainer elements 20*a* are provided to interconnect the base section 16*a* and main section 14*a* of the housing 12*a*. The retainer elements 20*a* include a plurality of retainer arms 34*a* and 36*a*. Although only two retainer arms 34*a* and 36*a* have been illustrated in FIG. 6, it should be understood that a third retainer arm, corresponding to the retainer arm 38 is provided. Of course, if desired, a greater or lesser number of retainer arms could be utilized.

Hemispherical projections 44*a* and 46*a* on the retainer arms 34*a* and 36*a* engage hemispherical recesses 24*a* and 26*a* in the reinforcing section 76*a* of the main section 14*a* of the housing 12*a*. Although only two recesses 24*a* and 26*a* are illustrated in FIG. 6, it should be understood that there is a third hemispherical recess in the reinforcing section 76*a* of the housing 12*a*, that is, a recess corresponding to the recess 28 of FIG. 2.

The centers of curvature of the hemispherical projections 44*a* and 46*a* on the retainer arms 34*a* and 36*a* are offset from the centers of curvature of the hemispherical recesses 24*a* and 26*a*. This results in the main section 14*a* of the housing 12*a* being pulled downward (as viewed in FIG. 6) and firmly pressed against a circular upper side surface 68*a* on a cylindrical body 56*a* of the base section 16*a*.

A circular diaphragm 82*a* is disposed in an end of the cylindrical body section 78*a* opposite from the reinforcing section 76*a*. The flexible diaphragm 82*a* is surrounded by an annular ridge 88*a* which protects the diaphragm 82*a* and decouples the diaphragm from the cylindrical side wall 74*a* of the main section 14*a* of the housing 12*s*. The illustrated diaphragm 82*a* has a thick circular central portion 100. The central portion 100 of the diaphragm 82*a* is connected with the cylindrical side wall 74*a* by a relatively thin annular connector section 102. The connector section 102 enables the relatively thick central portion 100 of the diaphragm 82*a* to readily vibrate or oscillate relative to the side wall 74*a*.

To minimize stress concentrations, the connector section 102 includes inner and outer curved surfaces 103 and 104. The inner curved surface 103 has a cross sectional configuration which forms a portion of a circle having a center of curvature in the chamber 86*a*. The inner curved surface 103 has an annular configuration and extends around the thick central portion 100. The annular inner curved surface 103 has a center which is disposed on a longitudinal central axis of the cylindrical side wall 74*a*. The inner curved surface 103 faces toward the base section 16*a* of the housing 12*a*.

The outer curved surface 104 has a cross sectional configuration which forms a portion of a circle having a center of curvature outside the housing 12*a*. The outer curved surface 104 has an annular configuration and extends around the thick central portion 100. The annular outer curved surface 104 has a center which is disposed on a longitudinal central axis of the cylindrical side wall 74*a*. The outer curved surface 104 faces away from the base section 16*a* of the housing 12*a*.

A cylindrical voltage/oscillation transducer element 108 is disposed in a cylindrical chamber 86*a* of the housing 12*a*. The upper (as viewed in FIG. 6) end of the voltage/oscillation transducer element 108 is disposed in engagement with the central portion 100 of the diaphragm 82*a*. A lower (as viewed in FIG. 6) end of the voltage/oscillation transducer element 108 is disposed in engagement with a cylindrical stainless steel base 110.

The transducer element 108 and base 110 are acoustically insulated from the housing 12*a*. A cylindrical tube 114 of closed cell foam extends around the cylindrical base 110. A cylindrical disk 116 of closed cell foam is disposed at the end of the base 110 opposite from the voltage/oscillation transducer element 108. A cylindrical layer 120 of potting compound is utilized to close the lower (as viewed in FIG. 6) end of the chamber 86*a*. A terminal pin 124 extends through the potting compound 120, layer 116 of closed cell foam to the stainless steel base 110. The terminal pin 124 is electrically connected with the voltage/oscillation transducer element 108 by an electrically conductive glue 130.

The main section 14*a* and base section 16*a* of the housing 12*a* may be formed of the same material or of different materials. The main section 14*a* and base section 16*a* of the housing 12*a* may be formed of suitable metal or polymeric materials. The main section 14*a* of the housing 12*a* is formed of "Ultem" (trademark). The base section 16*a* of the housing 12*a* is integrally molded as one piece of a suitable polymeric material.

Ultrasonic Transducer—Second Embodiment

Figure 7:
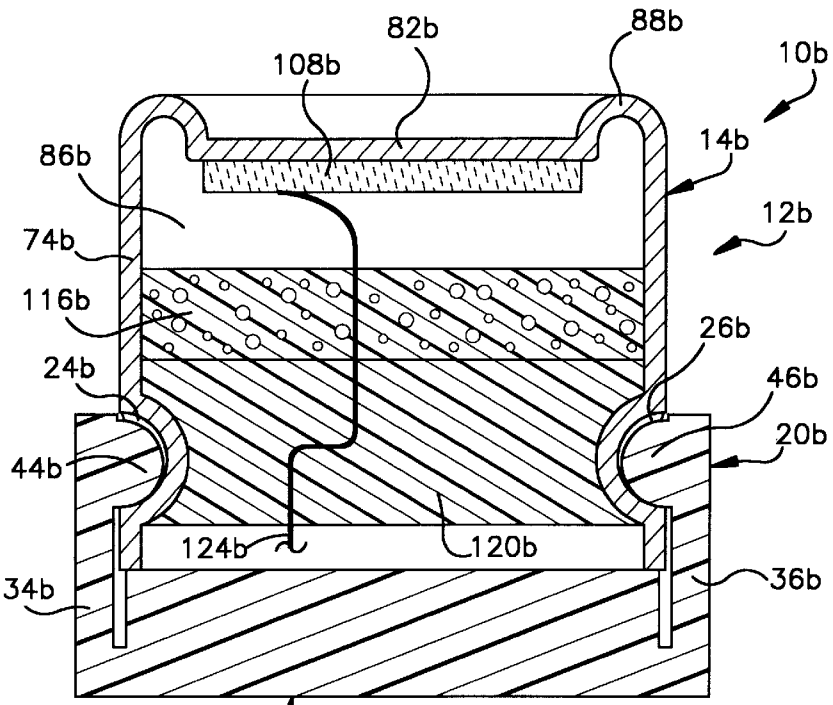
FIG. 7 is a sectional view of a second embodiment of an ultrasonic transducer having a housing constructed in accordance with the present invention.

The embodiment of the ultrasonic transducer illustrated in FIG. 7 is generally similar to the embodiment of the ultrasonic transducer illustrated in FIGS. 1–6. Therefore, similar numerals will be utilized to designate similar components, the suffix letter "b" being associated with the numerals of FIG. 7 to avoid confusion.

An ultrasonic transducer 10*b* has an improved housing 12*b*. The housing 12*b* includes a main section 14*b* and a base section 16*b*. Retainer elements 20*b* interconnect the base section 16*b* and main section 14*b* of the housing 12*b*. The retainer elements 20*b* include retainer arms 34*b* and 36*b*. Although only two retainer arms 34*b* and 36*b* have been illustrated in FIG. 7, it should be understood that a third retainer arm, corresponding to the retainer arm 38 of FIGS. 1 and 3, extends from the base 16*b*. The retainer arms 34*b* and 36*b* have hemispherical projections 44*b* and 46*b*.

Hemispherical recesses 24*b* and 26*b* in the main section 14*b* of the housing 12*b* are engaged by the hemispherical projections 44*b* and 46*b* on the retainer arms 34*b* and 36*b*. Although only the recesses 24*b* and 26*b* have been illustrated in FIG. 7, it should be understood that there is a third recess, corresponding to the recess 28 of FIG. 2, in the main section 14*b* of the housing 12*b*. Of course, a greater or lesser number of retainer elements 20*b* could be utilized if desired.

The main section 14*b* of the housing 12*b* includes a diaphragm 82*b*. An annular ridge 88*b* extends around the diaphragm 82*b* to protect the diaphragm and decouple the diaphragm from the side wall 74*b* of the main section 14*b* of the housing 12*b*.

A voltage/oscillation transducer element 108*b* is secured to the diaphragm 82*b*. Open space is provided in a chamber 86*b* between the voltage/oscillation transducer element 108*b* and a cylindrical layer 116*b* of closed cell, acoustically insulating foam. A layer 120*b* of potting compound closes the lower (as viewed in FIG. 7) end of the chamber 86*b*. An electrical terminal 124*b* is connected with the voltage/oscillation transducer element 108*b*.

In the embodiment of the invention illustrated in FIG. 7, the main section 14*b* of the housing 12*b* is formed of stainless steel. The ceramic voltage/oscillation transducer element 108*b* is connected with the diaphragm 82*b* by an electrically conductive glue. The base 16*b* of the housing 12*b* is integrally molded as one piece of a suitable polymeric material.

From the above description of the invention, those skilled in the art will perceive improvements, changes and modifications. Such improvements, changes and modifications within the skill of the art are intended to be covered by the appended claims.

Having described the invention, the following is claimed:

1. An ultrasonic transducer comprising:

a base section;

a main section;

first and second retainer elements connected with said base section, said first and second retainer elements being spaced a first arcuate distance apart in a first direction about a periphery of said base section and being spaced a second arcuate distance apart in a second direction about the periphery of said base section; and third and fourth retainer elements connected with said main section, said third and fourth retainer elements being spaced the first arcuate distance apart in the first direction about a periphery of said main section and being spaced the second arcuate distance apart in the second direction about the periphery of said main section, said first arcuate distance being different than said second arcuate distance to enable said base and main sections of said ultrasonic transducer to be interconnected by said retainer elements only when said main section is in a predetermined orientation relative to said base section.

2. An ultrasonic transducer as set forth in claim 1 wherein said main section includes a diaphragm and a ridge which extends around said diaphragm and projects outward from said diaphragm.

3. An ultrasonic transducer as set forth in claim 2 wherein said diaphragm is disposed in a first end portion of said main section and said third and fourth retainer elements are disposed in a second end portion of said main section, said second end portion of said main section having a greater thickness than said first end portion of said main section.

4. An ultrasonic transducer as set forth in claim 1 wherein said main section includes a diaphragm, said diaphragm includes a central portion and a recess which extends around said central portion of said diaphragm, said recess has an arcuate cross sectional configuration to minimize stress concentrations.

5. An ultrasonic transducer as set forth in claim 1 wherein said first and second retainer elements cooperate with said third and fourth retainer elements to urge said base section and said main section toward each other.

6. An ultrasonic transducer as set forth in claim 1 wherein said main section includes a cylindrical side wall, a circular diaphragm integrally formed as one piece with said side wall and connected with a first end portion of said side wall, said third and fourth retainer elements being connected with a second end portion of said side wall, said base section includes a cylindrical body and first and second arms which extend from said cylindrical body of said base section, said first and second retainer elements being disposed on end portions of said first and second arms and being engageable with said third and fourth retainer elements.

7. An ultrasonic transducer as set forth in claim 1 wherein said main section includes a side wall, said side wall having a body section and a reinforcing section which is disposed between said body section of said side wall and said base section, said reinforcing section having a thickness which is greater than a thickness of said body section to minimize distortion of said main section under the influence of force transmitted between said base section and said main section through said retainer elements.

* * * * *